US006481331B1

(12) United States Patent
Guo

(10) Patent No.: US 6,481,331 B1
(45) Date of Patent: Nov. 19, 2002

(54) WORKING CYLINDER ACTUATED BY HYDRAULIC FLUID

(75) Inventor: Xu Guo, Lohr/Main (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/762,488

(22) PCT Filed: Aug. 3, 1999

(86) PCT No.: PCT/EP99/05620

§ 371 (c)(1),
(2), (4) Date: Feb. 5, 2001

(87) PCT Pub. No.: WO00/09891

PCT Pub. Date: Feb. 24, 2000

(30) Foreign Application Priority Data

Aug. 12, 1998 (DE) ..... 198 36 422

(51) Int. Cl.[7] ..... F15B 15/22
(52) U.S. Cl. ..... 91/395; 91/396; 91/405
(58) Field of Search ..... 91/395, 396, 405, 91/406, 409

(56) References Cited

U.S. PATENT DOCUMENTS 2,598,446 A 5/1952 Schneider
4,064,788 A * 12/1977 Rich et al. ..... 91/395
4,352,318 A * 10/1982 Kolchinsky et al. ..... 91/395

FOREIGN PATENT DOCUMENTS

| | | |
|---|---|---|
| DE | 2214032 | 10/1972 |
| DE | 8809693 | 9/1988 |
| DE | 8809693 U1 * | 10/1988 |
| DE | 4307265 | 8/1994 |
| DE | 29608665 | 10/1997 |
| EP | 0837250 | 4/1998 |

* cited by examiner

*Primary Examiner*—Edward K. Look
*Assistant Examiner*—Thomas E. Lazo
(74) *Attorney, Agent, or Firm*—Martin A. Farber

(57) ABSTRACT

A pressure medium-actuated working cylinder axially displaceable between two end positions in a cylinder space, with opposite changes in, the volumes of two cylinder chambers on its two sides. A damping element is arranged on one side of a piston. A passage aperture is located between one cylinder chamber and a cylinder connection when the piston runs into one end position forming an annular throttle gap with the passage aperture for outflow of pressure medium. For a high damping capacity, the outer surface of the damping element is shaped to have a maximum diameter at the beginning of the passage aperture and, after a surface section, a small diameter, A middle diameter lies between the maximum diameter and the small diameter.

10 Claims, 3 Drawing Sheets

WORKING CYLINDER ACTUATED BY HYDRAULIC FLUID

FIELD AND BACKGROUND OF THE INVENTION

The invention relates to a pressure medium-actuated working cylinder in which the piston, on running into an end position, is braked by throttling of the pressure medium outflow from the shrinking cylinder chamber. As a result of the throttling of the output flow of pressure medium a pressure is built up in the shrinking cylinder chamber that generates a force on the piston that is directed against the movement of the piston.

What is referred to as the damping pressure building up in the cylinder chamber should, in this case, not exceed a maximum value which is from 1.5 times to twice as high as the nominal pressure of the working cylinder. On the other hand, the working cylinder has maximum damping capacity if the damping pressure has the maximum value throughout the damping stretch. Even theoretically, this ideal course of the damping pressure can only be achieved by the formation of the throttle cross sections and the throttle length between the damping element and the passage aperture if the same framework conditions are always maintained, in other words if the working cylinder, for example, is always moved at the same speed and moves the same mass. An attempt is then made, for the case of maximum speed and maximum mass, to obtain the ideal end position damping, so that the damping pressure no longer reaches the maximum value at lower speeds and lower masses.

Pressure medium-actuated working cylinders with end position damping are known from a number of publications. Thus, for example, EP 0 837 250 A2 shows a working cylinder in which the damping element has throttle grooves extending axially on its outer surface and tapering in their cross section. The throttle cross section over the throttle grooves becomes smaller and smaller as the damping element is inserted into the passage aperture. In addition to the throttle grooves, after the damping element is inserted into the passage aperture between the cylinder chamber and the cylinder connection, a pressure medium connection is switched on via a throttle point whose hydraulic resistance is largely independent of the depth of insertion of the damping element.

DE-OS 22 14 032 recites a pressure medium-actuated working cylinder. In this type of working cylinder, the outer surface of the damping element is rotationally symmetrical. In the known working cylinder, an entry whose effect is negligible for the end position damping, is adjoined by a surface section with a smaller diameter, which is followed approximately from the center of the damping element by a surface section with a larger diameter, which extends to the piston end of the damping element.

SUMMARY OF THE INVENTION

It is an object of the invention to develop a pressure medium-actuated working cylinder so that a high damping capacity is achieved, in other words so that a large mass can be braked over a short travel, without any expectation of damage caused by pressure peaks.

This object is achieved with a pressure medium-actuated working cylinder which additionally has the features of the invention. In a working cylinder according to the invention, then, viewed in the direction of insertion of the damping element into the passage aperture, the damping element has, before the section of smaller diameter, an average diameter which lies between the maximum diameter at the piston end of the damping element and the smaller diameter. This prevents the damping pressure falling rapidly again after a sharp rise at the start of insertion of the damping element into the passage aperture, so that it remains at a high level. The average diameter exists only over a short stretch relative to the length of the surface section of small diameter, which prevents the damping pressure exceeding the maximum admissible pressure, in other words prevents the working cylinder being damaged by pressure peaks. It has been found that, with the damping element constructed according to the invention, a course of the damping pressure close to the ideal curve can be achieved for a particular speed and mass.

According to features of the invention surface sections with, respectively, a fixed large diameter, a fixed small diameter and a fixed average diameter are provided. The diameter of the damping element thus does not change continuously during progression in the axial direction. The second surface section, according to feature of the invention, advantageously makes a transition into further surface sections with a diameter changing continuously during axial progression, into the first surface section and into the third surface section.

BRIEF DESCRIPTION OF THE DRAWINGS

An example of embodiment of a pressure medium-actuated working cylinder according to the invention, and a diagram in which, for various speeds, the damping pressure has been plotted over the damping travel, are shown in the drawings. The invention is now explained in detail with reference to these drawings.

In the drawings.

DETAILED DESCRIPTION OF THE PREFERRED EMBODIMENT

Figure 1:
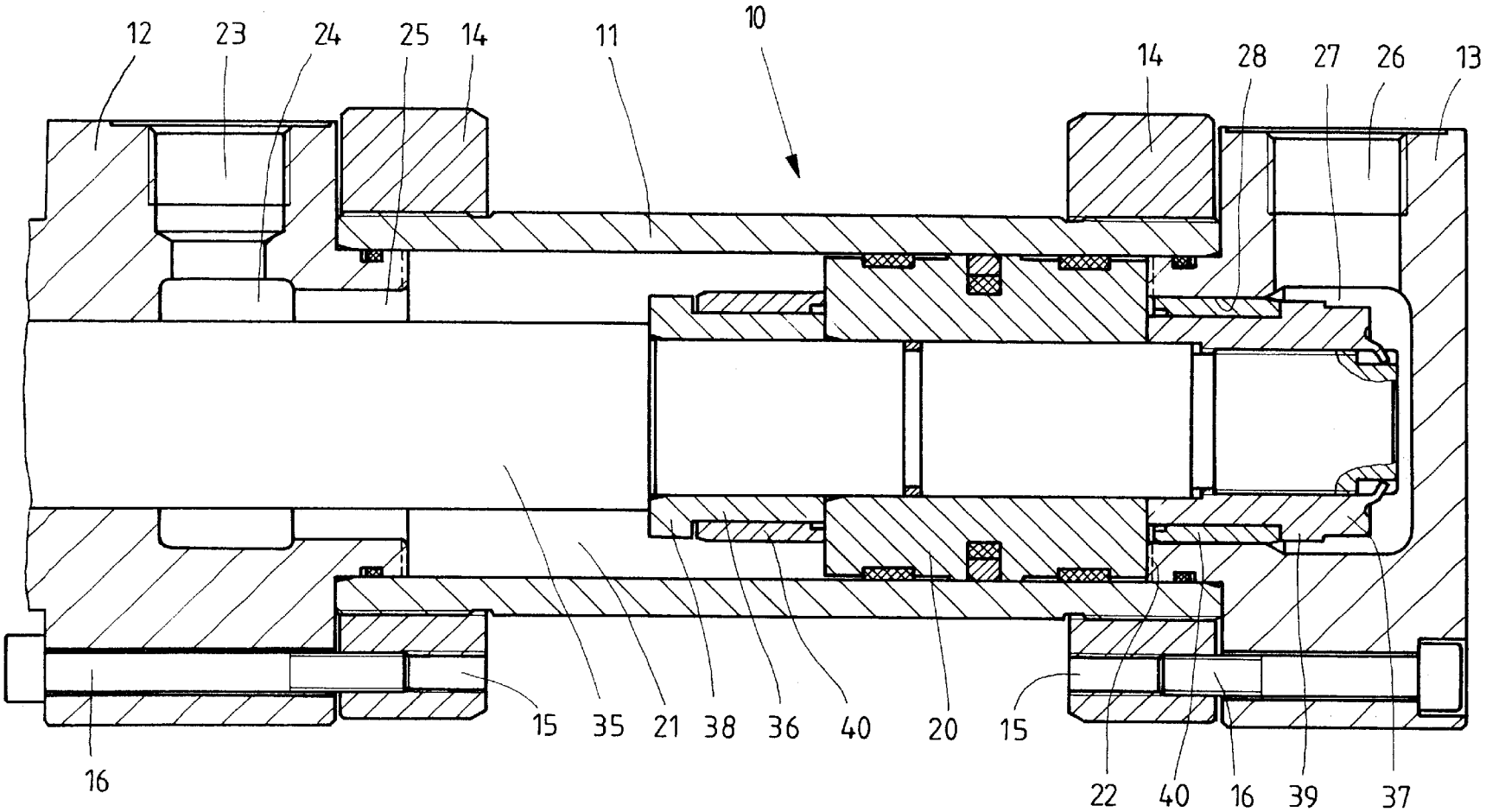
FIG. 1 shows a longitudinal section through a hydraulic working cylinder according to the invention.

The hydraulically operated working cylinder shown in FIG. 1 is a cylinder of what is known as the circular construction type. The cylinder housing 10 has, as essential components, a cylinder tube 11 and a cylinder head 12 placed on one end and a cylinder base 13 placed on the other end of the cylinder tube 11. To fix the cylinder tube, cylinder head and cylinder base to one another, a flange 14 is screwed onto each of the two ends of the cylinder tube 11, provided with an outer thread, the flange 14 having threaded axial holes distributed over 360° into which screws 16 tensioning the cylinder head and the cylinder base, respectively, against the cylinder tube are screwed.

In the interior of the cylinder tube 11, a piston 20 is guided to slide axially in close contact and divides the interior of the cylinder tube into two cylinder chambers 21 and 22 whose volumes change in opposite directions when the piston moves. Hydraulic pressure medium can be fed to the cylinder chamber 21 and removed from that cylinder chamber via a cylinder connection 23 in the cylinder head 12. The radially arranged cylinder connection 23 here opens initially into a chamber 24 in the cylinder head 12, which chamber 24 is in fluid connection with the cylinder chamber 21 via an axial passage aperture 25 of a particular diameter. Similarly, a pressure medium path runs from a radial cylinder connection 26, a chamber 27 and an axial passage aperture 28 in the cylinder base 13 to the cylinder chamber 22. The two passage apertures 25 and 28 in the cylinder head and in the cylinder base, respectively, have the same diameter.

The piston 20 is combined with a piston rod 35, which emerges to the outside through the cylinder head 12 and converts the chamber 24 and the passage aperture 25 of the cylinder head 12 to annular spaces. The piston 20 is pushed from the inner end via a reduced-diameter section of the piston rod 35 and tensioned against a shoulder of the piston rod 35 with the interposition of a flanged bush 36 and with the aid of a nut 37 screwed onto the threaded end of the piston rod 35.

A damping bush 40 is arranged axially between the piston 20 and the flange 38 of the flanged bush 36, on the latter and with axial and radial play, performing the function of a throttle body and of a return valve body. An identical damping bush 40 is arranged with axial and radial play between the piston 20 and a flange 39 of the nut 37.

Figure 2:
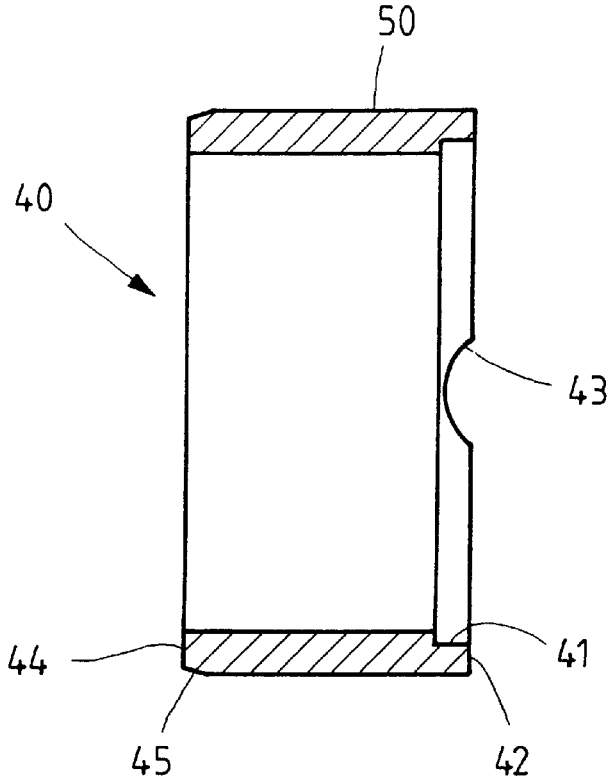
FIG. 2 shows a longitudinal section, turned through 90° relative to FIG. 1, through a damping bush used in the working cylinder shown in FIG. 1.
Figure 3:
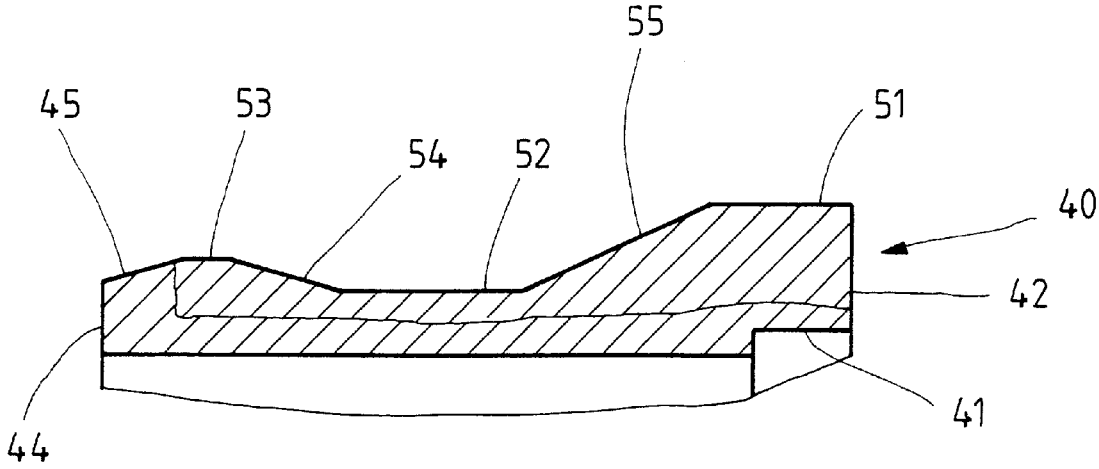
FIG. 3 shows a section of FIG. 2 with a partially vertically exaggerated representation of the outer surface of the damping bush.

The shape of the damping bushes is more clearly apparent from FIGS. 2 and 3. A damping bush 40 has a constant internal diameter over its entire length, with the exception of a turned recess 41 on its end face 42 facing the piston 20, this internal diameter being adapted to the external diameter of the flanged bush 36 and of the nut 37 so that a radial play of, for example, 0.5 mm results. In terms of length, the damping bush 40 is, for example, 0.3 mm shorter than the clear distance between the piston 20 and a flange 38, 39. On its end face 42, the damping bush has two diametrically opposite recesses 43 in the form of circular segments which are not quite as deep as the turned recess 41. On the end face 44 remote from the piston 20, the damping bush has a run-up ramp 45, which guarantees that the damping bush is threaded into the passage aperture 25 or 28, despite the radial play. Even if the run-up ramp 45 is omitted, the diameter of the outer surface 50 of the damping bush 40 is not constant over its length. The diameter is largest in a first surface section 51 beginning directly at the end face 42. In the example of embodiment considered, the diameter in the surface section 51 is 30 $\mu$ less than the 48 mm diameter of the passage holes 25 and 28. Axially, the first surface section 51 extends further, about 1 mm in the present example of embodiment, from the end face 42 of the damping bush 40 than the recesses 43. In a second surface section 52, the outer surface 50 of the damping bush 40 has a constant smallest diameter over a length of about 8 mm which is approximately 110 $\mu$ less than the diameter of the passage apertures 25 and 28. Furthermore, a third axially extending surface section 53 with a constant diameter is provided. Specifically, the diameter in the surface section 53 is about 80 $\mu$ less than the diameter of the passage apertures 25 and 28. The surface section 53 directly adjoins the run-up ramp 45 and extends over a length of approximately from 1 to 2 mm. Its diameter lies between the diameters in the surface section 52 and in the surface section 51. Between the two surface sections 52 and 53 is a frustum-like surface section 54, in which the diameter increases from the diameter in surface section 52 to the diameter in the surface section 53. Finally, in a frustum-shaped surface section 55, the diameter of the outer surface 50 of the damping bush 40 increases from the diameter in the surface section 52 to the diameter in the surface section 51. In this case, the surface section 55 is axially longer than the surface section 54. Its length is approximately from 6 to 7 mm, while the surface section 54 is only approximately 3 mm long. The overall length of the damping bush in the present case is approximately 24.5 mm.

In the position of the piston 20 shown in FIG. 1, the damping bush 40 is axially seated on the flange 39 of the nut 37. If pressure medium is now fed to the cylinder connection 26, the damping bush 40 is displaced by the force generated by the rising pressure by the amount of its axial play toward the piston 20 until its end face 42 rests against the piston. Pressure medium can now flow through the axial gap between the end face 44 of the damping bush 40 and the flange 39 of the nut 37, through the radial gap, existing as a result of the radial play, between the damping bush 40 and the nut 37, and through the recesses 43 of the damping bush 40 into the cylinder chamber 22. The hydraulic resistance of the flow path described along the inner wall of the damping bush 40 is much less than the hydraulic resistance between its outer surface and the wall of the passage aperture 28. The piston 20 now moves toward the cylinder head 12 at a speed corresponding to the volume of pressure medium flowing in via the cylinder connection 26, pressure medium from the shrinking cylinder chamber 21 being forced via the passage aperture 25 and the cylinder connection 23. At a determined distance between the piston 20 and the cylinder head 12, the other damping bush 40, which is guided on the flanged bush 36, begins to become inserted into the passage aperture 25. As a result, the flow cross section available for the outflow of pressure medium from the cylinder chamber 21 through the passage hole 25 is reduced. The pressure in the cylinder chamber 21 thus becomes higher than the pressure in the chamber 12 and in the cylinder connection 23 of the cylinder head 12, so that the damping bush 40 is moved away from the piston 20 onto the flange 38 of the flange bush 36 and rests with its end face 44 on the flange. Like the movable body of a return valve, the damping bush 40 thus blocks the flow path along the radial gap between itself and the flange bush 36. The surface section 53 of the damping bush 40 then enters the passage aperture 25. The flow path along the outside of the damping bush 40 becomes very narrow, and the pressure in the cylinder chamber 21 rises relatively quickly. After only a short further travel of the piston 20, of course, the surface sections 54 and 52 of the damping bush 40 enter the passage aperture 25, which prevents the damping pressure in the cylinder chamber 21 rising beyond the intended maximum value. As a result of the rising damping pressure in the cylinder chamber 21, the piston 20 is braked. The surface sections 55 and 51 of the damping bush 40 then enter the passage aperture 25, as a result of which the hydraulic resistance along the flow path on the outside of the damping bush 40 once again rises sharply and a damping pressure close to the maximum pressure is maintained in the cylinder chamber 21, although, because the speed of the piston 20 is now already low, the volume of pressure medium to be forced out of the cylinder chamber 21 per unit of time is also low. Finally, the piston 20 arrives at very low speed in its end position on the cylinder head 12. Travel out of this end position into the starting position shown in FIG. 1 takes place in a similar way to travel out of the starting position.

Figure 4:
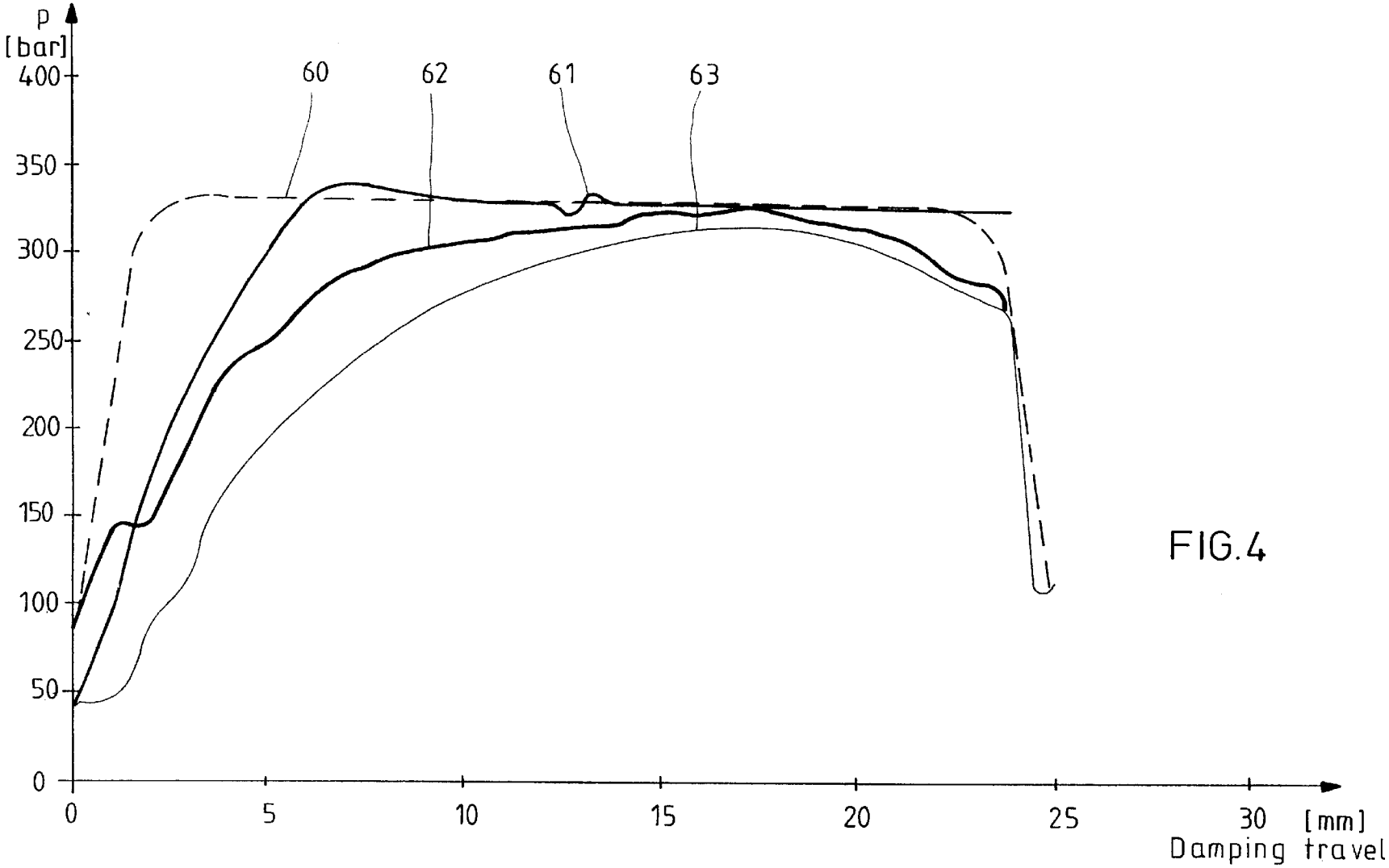
FIG. 4 is a diagram in which the measured damping pressure is plotted over the damping travel for two piston speeds.

In the diagram shown in FIG. 4, various curves are illustrated which show a damping pressure in a cylinder chamber plotted over the damping travel, the zero point of the damping travel being located at the start of the insertion of the damping bush into a passage aperture. The broken-line curve 60 represents an ideal damping curve. The damping pressure rises quickly to the maximum value, remains at that value almost throughout the entire damping travel, and falls sharply only at the end. The curve 61 is calculated on the basis of certain framework conditions, such as for example a maximum speed of the piston, and assuming a particular mass of a damping bush formed according to the invention. The curve 62 has been plotted in an experiment based on the same framework conditions as were assumed in calculating the curve 61, in particular the same speed of the piston and the same moved mass. The curve 63 has been plotted with a lower piston speed at the beginning of damping. The speed here was approximately 300 mm/s, while the plotting of the curve 62 was based on a speed of 500 mm/s. It is noticeable that the damping pressure rises less quickly at lower speed, with the same damping bush and the same passage aperture. This is not at all surprising, since in accordance with the lower speed, a lower volume of pressure medium is initially forced through the throttle flow path between the damping bush and the wall of the passage aperture.

I claim:

1. A pressure medium-actuated working cylinder with a piston (20) to which a piston rod (35) is fixed and which is axially displaceable between two end positions in a cylinder space, with opposite changes in the volumes of two cylinder chambers (21, 22) on its two sides, with a damping element (40) arranged on one side of the piston (20), having a rotationally symmetrical outer surface (50) with surface sections (51, 52, 53, 54, 55) of different diameters, entering a passage aperture (25, 28) between one of said cylinder chambers (21, 22) and a cylinder connection (23, 26) when the piston (20) runs into one end position, and so forming, with the passage aperture (25, 28), an annular throttle gap for the throttled outflow of pressure medium from the cylinder chamber (21, 22) to the cylinder connection (23, 26), wherein the outer surface (50) of the damping element (40) in an area serving to form the throttle gap is so shaped that, viewed with the damping element (40) entirely inserted, it has a maximum diameter at the beginning of the passage aperture (25, 28) at the chamber end, and, after a surface section (52) of a small diameter or small diameters with the damping element (40) inserted to a considerable extent, has, over a short stretch, a middle diameter which lies between the maximum diameter and the small diameter, wherein the outer surface (50) of the damping element (40) has a first surface section (51) with a fixed large diameter and extending over a certain axial distance, a second surface section (52) with a fixed small diameter and extending over a certain axial distance, and a third surface section (53) with a fixed middle diameter and extending over a certain axial distance.

2. The pressure medium-actuated working cylinder as claimed in claim 1, wherein the difference between the diameter of the passage hole (25, 28) and the middle diameter of the damping element (40) is from 3 to 4 times as great, and that between the diameter of the passage hole (25, 28) and the small diameter is from 4.5 to 6 times as great, as the difference between the diameter of the passage hole (25, 28) and the largest diameter.

3. The pressure medium-actuated working cylinder as claimed in claim 2, wherein the difference in diameter between the passage hole (25, 28) and the damping element (40) is from 10 to 40 micrometers in the area of the large diameter, from 40 to 120 micrometers in the area of the middle diameter and from 60 to 180 micrometers in the area of the small diameter.

4. The pressure medium-actuated working cylinder as claimed in claim 1, wherein the second surface section (52) makes a transition, in further of said surface sections (54, 55) with a diameter that changes continuously in course of axial progression, into the first surface section (51) and into the third surface (53).

5. The pressure medium-actuated working cylinder as claimed in claim 4, wherein the further surface sections (54, 55) are frustum-shaped outer surfaces.

6. The pressure medium-actuated working cylinder as claimed in claim 4, wherein the further surface section (55) between the second surface section (52) and the first surface section (51) is axially longer than the further surface section (54) between the second surface section (52) and the third surface section (53).

7. The pressure medium-actuated working cylinder as claimed in claim 4, wherein axial extent of the second surface section (52) is much greater than the axial extent of the first surface section (51) or of the third surface section (53).

8. Pressure medium-actuated working cylinder as claimed in claim 1, wherein axial extent of the surface section or sections (52, 54, 55) located between the first surface section (51) and the third surface section (53) is much greater than the axial extent of the first surface section (51) or of the third surface section (53).

9. The pressure medium-actuated working cylinder as claimed in claim 1, wherein axial extent of the first surface section (51) and of the third surface section (53) is in the range between 1 and 3 mm, depending on cylinder size.

10. The pressure medium-actuated working cylinder as claimed in claim 1, wherein the difference in diameter between the passage hole (25, 28) and the damping element (40) is from 10 to 40 micrometers in the area of the large diameter, from 40 to 120 micrometers in the area of the middle diameter and from 60 to 180 micrometers in the area of the small diameter.

* * * * *